United States Patent [19]

Djordjevic

[11] 4,422,209

[45] Dec. 27, 1983

[54] MANIFOLD TOOL GUIDE

[75] Inventor: Aleksandar Djordjevic, Thousand Oaks, Calif.

[73] Assignee: The United States of America as represented by the United States Department of Energy, Washington, D.C.

[21] Appl. No.: 396,191

[22] Filed: Jul. 8, 1982

[51] Int. Cl.[3] ..... B08B 9/04

[52] U.S. Cl. ..... 15/257 R; 15/104.3 SN

[58] Field of Search ..... 15/104.3 SN, 104.16, 15/257 R; 254/134.3 FT, 389; 134/8, 166 C, 167 C

[56] References Cited

U.S. PATENT DOCUMENTS

| | | | |
|---|---|---|---|
| 1,215,189 | 2/1917 | Price . | |
| 3,043,121 | 7/1962 | Truman . | |
| 3,444,578 | 5/1969 | Caperton | 15/104.3 SN |
| 3,497,899 | 3/1970 | Caperton | 15/104.3 SN |
| 3,522,815 | 8/1970 | Prange | 15/104.3 SN X |
| 3,525,112 | 8/1970 | Masters | 15/104.12 |
| 3,971,544 | 7/1976 | Smith, Jr. | 254/134.3 FT |
| 4,006,508 | 2/1977 | Brown | 15/104.3 SN X |

*Primary Examiner*—Edward L. Roberts

*Attorney, Agent, or Firm*—L. E. Carnahan; Robert S. Gaither; Richard G. Besha

[57] ABSTRACT

A tool guide that makes possible the insertion of cleaning and/or inspection tools into a manifold pipe that will dislocate and extract the accumulated sediment in such manifold pipes. The tool guide basically comprises a right angled tube (or other angled tube as required) which can be inserted in a large tube and locked into a radially extending cross pipe by adjustable spacer rods and a spring-loaded cone, whereby appropriate cleaning tools can be inserted into to cross pipe for cleaning, inspection, etc.

13 Claims, 3 Drawing Figures

MANIFOLD TOOL GUIDE

BACKGROUND OF THE INVENTION

The invention described herein arose in the course of, or under, Subcontract No. L/C 78012038 with Rockwell International Corporation under Contract No. DE-AC03-79SF10499 between the U.S. Department of Energy and McDonnell Douglas Astronautics Company.

The invention relates to apparatus for cleaning or inspection of pipes, manifolds, etc., particularly to a cleaning or inspection tool guide, and more particularly to a tool guide having a locking mechanism for positioning the guide.

Various mechanisms have been developed for directing tools, cables, cleaning devices into conduits, tubes and pipes, where the conduit, etc. is positioned at an angle with respect to an accessible opening. Also, various approaches have been developed for securing or locking tool guides in a desired location to enable insertion of a tool therethrough and into the desired conduit, tube, or pipe. These prior known mechanisms are exemplified by U.S. Pat. Nos. 1,215,189 issued Feb. 6, 1917 to J. Price; 3,444,578 issued May 20, 1969 to C. B. Caperton; 3,497,899 issued Mar. 3, 1970 to C. B. Caperton; 3,522,815 issued Aug. 4, 1970 to C. J. Prange; and 3,971,544 issued July 27, 1976 to R. W. Smith, Jr.

Manifold systems for distributing or conveying materials, such as oil, rock, etc. require periodic inspection and/or cleaning. Many of these manifold systems, such as oil distributing manifolds for rock and oil filled thermal storage tanks, have to be cleaned in place. The access to such manifold pipes to be cleaned is possible only through much larger collector or distributor pipes. Thus, it is necessary to insert the inspection/cleaning mechanism through the large collector pipes and align same with the smaller manifold pipes to enable insertion of the inspection/cleaning tool into the smaller pipes.

While the various types of prior tool guide apparatus have been effective to a certain extent, a need existed for a more effective tool guide for pipe cleaning/inspection devices, which enabled rapid in place cleaning of various pipes of a manifold system.

Therefore, it is an object of this invention to provide a tool guide for cleaning and/or inspection of pipes in a manifold system.

A further object of the invention is to provide a manifold cleaning tool guide capable of being located in position during operation.

Another object of the invention is to provide a cleaning tool guide adapted to be located in a large collector pipe and provided with means for adjustable positioning and locking same at a desired location for insertion of a tool into a smaller feeder pipe.

Another object of the invention is to provide a tool guide having an angled tube which can be inserted and locked into a pipe to be cleaned by apparatus which includes a plurality of spacer rods and a spring-loaded cone.

Other objects of the invention will become readily apparent from the following description and accompanying drawings.

SUMMARY OF THE INVENTION

The above objects of the present invention are carried out by a tool guide which has various applications but particularly adapted to the removal of sand deposits from oil distribution manifolds in rock filled thermal storage tanks. More specifically, the tool guide of the invention comprises an angled tube which can be inserted through a large collector or distributor pipe and locked into a smaller feeder or distributing pipe by adjustable spacer rods and a spring-loaded cone. The locking device is mounted on the bend of the tube to insure the positioning of the tool guide and the locking of the same to prevent movement after the forward end of the tube is inserted in a pipe to be inspected and/or cleaned.

DETAILED DESCRIPTION OF THE INVENTION

Figure 1:
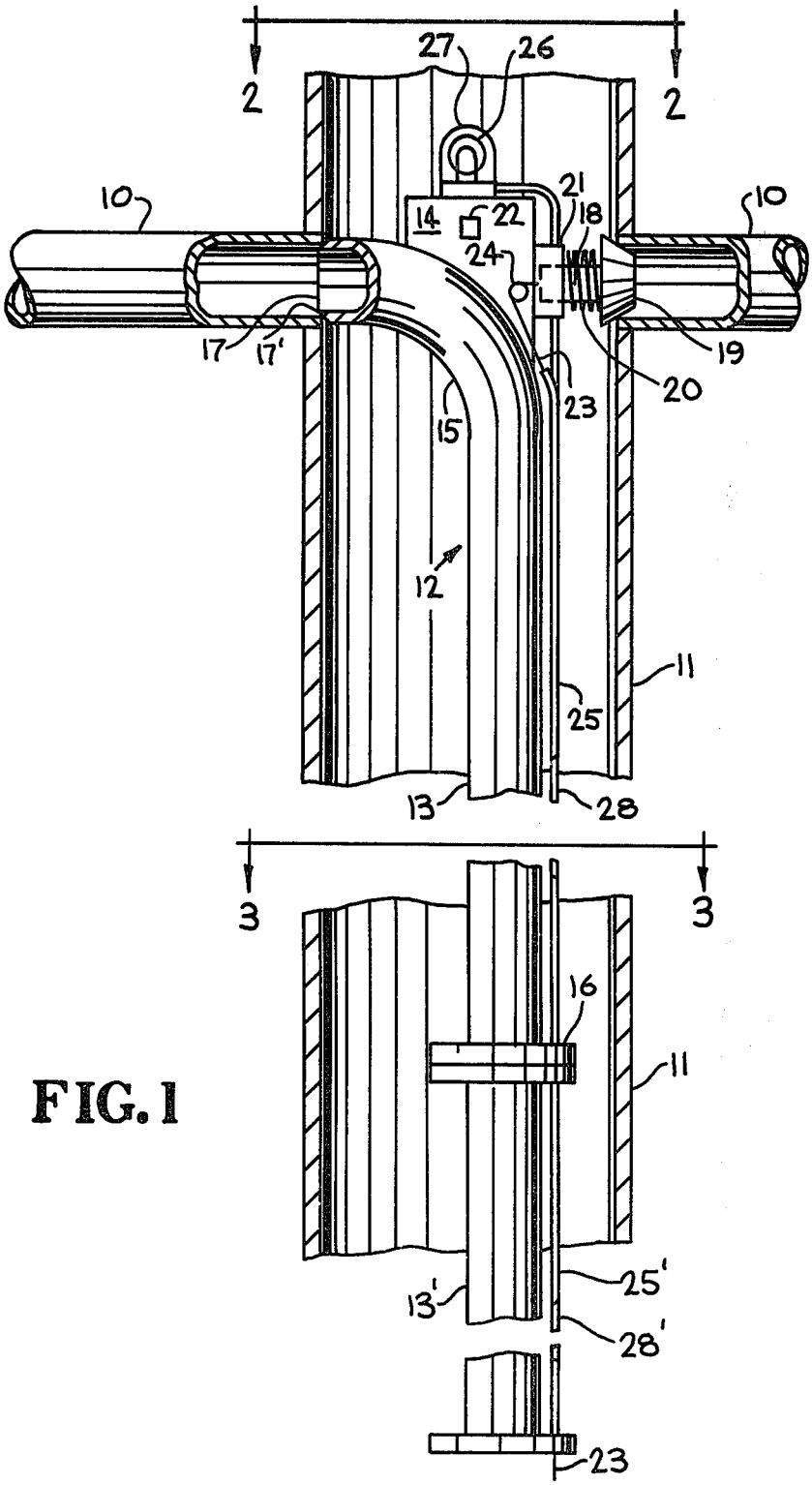
FIG. 1 is a top view of an embodiment of the invention mounted for operation in a manifold system.

The present invention is directed to a tool guide for the cleaning, inspection, etc. of pipes accessible only through connection with a larger diameter pipe. Manifold systems, such as oil distributing manifold and those utilized in rock and oil filled thermal storage tanks, involve a number of small diameter (3–4 inch) feeder or distributing pipes which are connected to a larger diameter (16–18 inch) collector or distributor pipe. In order to inspect or clean the feeder pipes, access is had via the collector pipe and involves insertion of cleaning or inspection tools into the feeder pipe at an angle with respect to the longitudinal axis of the collector pipe.

The tool guide of the present invention utilizes an angled tube which can be inserted in a collector pipe and locked into a feeder pipe by adjustable spacer rods and a spring-loaded cone. The cleaning or inspection mechanism is then inserted through the angled tube into the feeder pipe.

Referring now to the drawings, the embodiment of the tool guide described hereinafter is specifically applicable to oil distributing manifolds wherein accumulated sediment in the manifold or feeder pipes must be periodically removed. However, application of the tool guide is not limited to the specifically described use.

Figure 2:
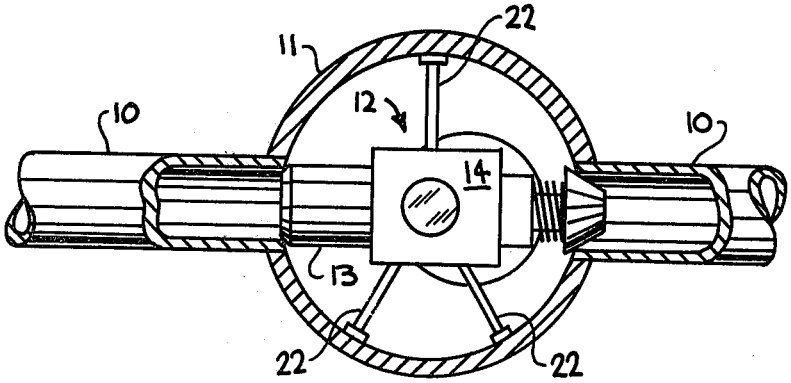
FIG. 2 is an end view of the FIG. 1 apparatus looking in the direction of lines 2—2.

As shown in FIGS. 1 and 2, a pair of smaller diameter feeder or manifold pipes 10 are connected to a larger diameter collector pipe 11. The tool guide, generally indicated at 12, basically consists of a guide tube or pipe 13 and a locking device 14 mounted at a 90° bend 15 in guide tube 13. Depending on the length of collector pipe 11, guide tube 13 may be provided with an extension section 13' connected via mating flanges 16. For example, the guide tube 13 is ten feet in length and extension section 13' is also ten feet long. Additional extension sections may be added as required. Also, the guide tube 13 has substantially the same outside diameter as the inside diameter of the manifold pipes 10. The outside diameter of guide tube 13 may be slightly larger than the manifold pipe 10 if desired. The inner end 17 of the guide tube 13 is cut so as to match the opening of the manifold pipes 10 and provided with a chamfered edge 17' which enables the insertion of about 0.25 inch of the tube into the manifold pipe.

Locking device 14, mounted on bend 15 of guide tube 13, insures the positioning of the tool guide 12 and locking of same in place to prevent movements after the front or forward end 17 of guide tube 13 is inserted in the manifold pipe 10. The locking device 14 includes a spring-loaded slide member 18 having a conically shaped end section 19 which is biased outwardly by a spring 20. Spring 20 is positioned around a shank section of slide member 18 an intermediate end section 19 and a support collar or flange 21. In the embodiment illustrated, the end section 19 of member 18 is configured so as to be partially inserted into a manifold pipe 10 located directly opposite to a manifold pipe in which the front end of the guide tube 13 is inserted. However, in manifold systems where the manifold pipes are not positioned directly opposite one another, as the illustrated embodiment, the conical end section 19 can be provided with a curved end surface configured to conform with the curvature of the collector pipe 11, so as to bear against the inner wall of the collector pipe.

Locking device 14 also includes a plurality of adjustable spacer rods or legs 22. Spacer rods 22 may be of the telescoping, spring-biased type so as to maintain a desired force against the inner wall of the collector pipe 11. Where desired, auxiliary sets of spacer rods may be positioned at spaced intervals (every 4 feet, for example) along the length of guide tube 13 to insure accurate positioning of the tool guide. While not shown these auxiliary sets of spacer rods would be secured to a collar which surrounds guide tube 13 and removably secured thereto.

Figure 3:
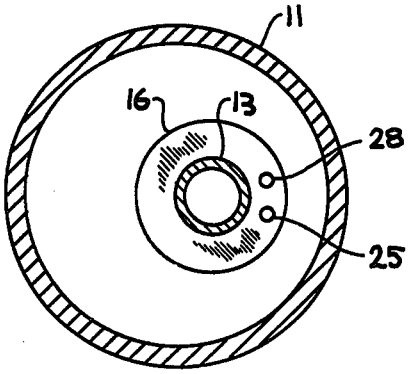
FIG. 3 is an enlarged cross-sectional view of the tool guide taken along line 3—3 of FIG. 1.

Locking device 14 also includes mechanism for overcoming the outwardly biasing force of spring 20 such that slide member 18 can be pulled inwardly to allow removal of guide tube end 17 from manifold pipe 10 and movement of the tool guide along collector pipe 11. This mechanism consists of a slide wire or cable 23 which is attached at one end to slide member 18, passes around a post or pin 24 and extends through a guard tube or pipe 25 attached to guide tube 13 (see FIGS. 1 and 3). As seen, a pulling force applied to the outer end of slide wire 23 causes the conical section 19 of slide member 18 to be retracted from manifold pipe 10. Where tube extension sections 13' are utilized as shown in FIG. 1, it is understood that guard tube extensions 25' for slide wire 23 are provided. The mating flanges 16 are provided with openings (not shown) to provide for passage of slide wire 23 therethrough. Guard tube 25 may consist, for example, of a ½ inch pipe.

To provide visibility for positioning the tool guide 12 in collector pipe 11, a light 26 positioned within a guard 27 is mounted on locking device 14. An electric power cable, not shown, for light 26 is located in a conduit 28 which extends parallel to guard tube 25 and secured to guide tube 13 (see FIGS. 1 and 3). Where extensions for guide tube 13 are utilized as in the illustrated embodiment, power cable conduit extension 28' are also provided. However, light 26 may be powered by a battery located in the locking device 14.

With the tool guide 12, having the necessary number of extensions installed, inserted into collector pipe 11 and with the front end 17 of guide tube 13 positioned in manifold 10 and locked therein by locking device 14 as shown in FIG. 1, standard inspection/cleaning equipment (not shown) is inserted through the guide tube 13 into the manifold pipe 10. For example, this equipment may include any or all of the following:

1. a flexible bore-scope for visual inspection.
2. a flexible "snake" with a cutter at the end to dislodge sediment in manifold pipe 10.
3. a compressed air hose to blow out the dislodged sediment.
4. a vacuum hose to extract dislodged particles.

It has thus been shown that the present invention provides an improved tools guide for inserting cleaning and/or inspection tools into a manifold system having feeder or distributing pipes that are accessible only through larger collector or distributor conduits. The advantages provided by the invention results from the combination of a guide tube and locking device which enables ready insertion of tools into the feeder pipes.

While the embodiment illustrated and described utilizes a guide tube having a 90° bend therein, it is understood that different bend angles may utilized where the manifold pipes are connected to the collector pipe at varying angles. Adapting for the different manifold pipe angles can be accomplished, for example, by utilizing interchangeable inner or forward end sections of the guide tube that are cut at the outer end so as to mate with the manifold pipe into which it is to be inserted.

Although a particular embodiment of the invention has been set forth, modifications and changes will become apparent to those skilled in the art, and is intended to cover in the appended claims all such modifications and changes that come with the scope of the invention.

What is claimed is:

1. A tool guide for use in the inspection and cleaning of pipes of a manifold system comprising: a guide tube defining an axis and having an angled end section; and a locking device mounted on said guide tube for retaining the end of said end section of said guide tube in contact with a pipe to be cleaned; said locking device including a plurality of adjustable leg members extending outwardly from said axis, a spring-loaded slide member extending outwardly from said axis, and means for moving said slide member.

2. The tool guide of claim 1, wherein said end of said end section of said guide tube is provided with a chamfered edge.

3. The tool guide of claim 2, wherein said end of said end section of said guide tube has an external diameter of approximately that of an internal diameter of an associated pipe to be cleaned, such that at last a portion of the chamfered edge of said end section is inserted into an associated pipe to be cleaned.

4. The tool guide of claim 2, wherein said end of said end section of said guide tube is cut so as to match an opening of an associated pipe to be cleaned.

5. The tool guide of claim 1, wherein said curved end section of said guide tube is curved at an angle of about 90°.

6. The tool guide of claim 5, wherein said locking device is positioned such that said spring-loaded slide member is located and extends in a direction substantially opposite a direction of said end of said section of said guide tube.

7. The tool guide of claim 1, wherein said locking device includes a housing having said plurality of adjustable leg members and said spring-loaded slide member secured thereto, said housing being secured to said curved end section of said guide tube.

8. The tool guide of claim 1, additionally including means for at least illuminating said end section of said guide tube.

9. The tool guide of claim 8, wherein said illuminating means comprises a light, a light guard, and means for supplying electrical power to said light.

10. The tool guide of claim 1, wherein said means for moving said slide member includes a wire having one end secured to said slide member, said wire extending along said guide tube to the end thereof opposite said one end of said end section.

11. The tool guide of claim 10, wherein said means for moving said slide member additionally includes a pin secured to said locking device and a pipe secured to said guide tube, said wire passing around said pin and extending through said pipe.

12. The tool guide of claim 1, wherein said spring-loaded slide member comprises a slide member having a shank portion and a conical shaped end portion, and a spring positioned around said shank portion and exerting a force against said conical shaped end portion.

13. The tool guide of claim 1, wherein said spring-loaded slide member is located to extend substantially opposite said end of said end section of said guide tube.

* * * * *